US012104397B2

(12) United States Patent
Yang

(10) Patent No.: US 12,104,397 B2
(45) Date of Patent: Oct. 1, 2024

(54) SEAMLESS ATTACHED TENT

(71) Applicant: Unipros Camping Products Company Limited, Fujian (CN)

(72) Inventor: Yonggeng Yang, Xiamen (CN)

(73) Assignee: Unipros Camping Products Company Limited, Fujian (CN)

( * ) Notice: Subject to any disclaimer, the term of this patent is extended or adjusted under 35 U.S.C. 154(b) by 164 days.

(21) Appl. No.: 17/899,956

(22) Filed: Aug. 31, 2022

(65) Prior Publication Data

US 2023/0075653 A1 Mar. 9, 2023

(30) Foreign Application Priority Data

Sep. 6, 2021 (CN) ..... 202122146784.7

(51) Int. Cl.

| | |
|---|---|
| ***E04H 15/54*** | (2006.01) |
| ***E04H 15/42*** | (2006.01) |
| ***E04H 15/56*** | (2006.01) |
| ***E04H 15/58*** | (2006.01) |
| ***E04H 15/64*** | (2006.01) |

(52) U.S. Cl.

CPC ..... *E04H 15/54* (2013.01); *E04H 15/42* (2013.01); *E04H 15/56* (2013.01); *E04H 15/58* (2013.01); *E04H 15/64* (2013.01)

(58) Field of Classification Search

CPC ..... E04H 15/42; E04H 15/54

USPC ..... 135/124

See application file for complete search history.

(56) References Cited

U.S. PATENT DOCUMENTS 4,192,333 A * 3/1980 Sato ..... E04H 15/425 135/156
4,305,414 A * 12/1981 Bareis ..... E04H 15/56 135/906
4,709,718 A * 12/1987 Nichols ..... E04H 15/40 135/97
5,067,505 A * 11/1991 Cantwell ..... E04H 15/40 135/125
5,913,322 A * 6/1999 Gallant ..... E04H 15/42 D21/834
6,167,898 B1 * 1/2001 Larga ..... E04H 15/20 135/124
6,681,785 B2 * 1/2004 Choi ..... E04H 15/32 135/137
7,267,135 B2 * 9/2007 Hardee ..... E04H 15/32 135/115
8,161,992 B2 * 4/2012 Cantwell ..... E04H 15/32 135/156
9,777,508 B2 * 10/2017 Kalvani ..... E04H 15/54
9,976,318 B2 * 5/2018 Lynch ..... E04H 15/40

(Continued)

*Primary Examiner* — Noah Chandler Hawk

(74) *Attorney, Agent, or Firm* — Cooper Legal Group, LLC

(57) ABSTRACT

A seamless attached tent includes an inner tent and an outer tent. The inner tent includes a tent cloth, one or more tent rods, and a base cloth. The tent cloth includes a plurality of cloth pieces and a plurality of adhesive layers, and adjacent cloth pieces of the plurality of cloth pieces are attached together through the plurality of adhesive layers. The one or more tent rods are connected to a periphery of the tent cloth. The base cloth is disposed on a lower side of the tent cloth. All sides of the base cloth extend upward to form a surrounding barrier. Corners of the surrounding barrier are attached with reinforcing blocks through the plurality of adhesive layers. The outer tent covers a top of the inner tent.

14 Claims, 4 Drawing Sheets

(56) References Cited

U.S. PATENT DOCUMENTS

| | | | | |
|---|---|---|---|---|
| 10,676,957 | B1 * | 6/2020 | Park | E04H 15/64 |
| 2009/0110911 | A1 * | 4/2009 | Van Halderen | B32B 33/00 428/480 |

* cited by examiner

SEAMLESS ATTACHED TENT

RELATED APPLICATIONS

This application claims priority to Chinese patent application number 202122146784.7, filed on Sep. 6, 2021. Chinese patent application number 202122146784.7 is incorporated herein by reference.

FIELD OF THE DISCLOSURE

The present disclosure relates to the field of outdoor products, and in particular to a seamless attached tent.

BACKGROUND OF THE DISCLOSURE

With the rise of outdoor sports, field outings, fishing, and outdoor camping have become common leisure activities. Outdoor weather is changeable, whether it is for sunshade, or to keep out the rain, tents are generally carried during the activity.

The tents are popular among outdoor enthusiasts because of their small size and easy portability. However, the structure of the tents is complex, and the tents usually need to be spliced with multiple pieces of cloth. The existing fabrics are all connected together by stitching, which will leave needle holes that destroy a waterproof coating of the existing fabrics and cause water leakage at a seam. Furthermore, considering the tents need to undergo the test of wind and rain during use, it is usually necessary to adopt a double-needle combination process to ensure the stability of the stitching. However, the difficulty of employing stitching workers has become a problem for most tent factories. The double-needle combination process that requires high craftsmanship will greatly increase the cost. There are broken needles hidden in the tent cloth that may also cause injury to the user.

BRIEF SUMMARY OF THE DISCLOSURE

The present disclosure provides a seamless attached tent to solve the deficiencies in the background.

In order to solve the technical problem, a first technical solution of the present disclosure is as follows.

A seamless attached tent comprises an inner tent and an outer tent. The inner tent comprises a tent cloth, one or more tent rods, and a base cloth. The tent cloth comprises a plurality of cloth pieces and a plurality of first adhesive layers, and adjacent cloth pieces of the plurality of cloth pieces are attached together through an adhesive layer of the plurality of first adhesive layers. The one or more tent rods are connected to a periphery of the tent cloth. The base cloth is disposed on a lower side of the tent cloth, and all sides of the base cloth extend upward to form a surrounding barrier. Corners of the surrounding barrier are attached with reinforcing blocks through a second adhesive layer. The outer tent covers a top of the inner tent.

In preferred embodiment, the plurality of cloth pieces comprise upper cloth pieces and lower cloth pieces, and bottom edges of the upper cloth pieces are attached to top edges of the lower cloth pieces.

In preferred embodiment, the tent cloth is disposed with a door curtain, a joint between a fixed side of the door curtain and the tent cloth is disposed with another adhesive layer of the plurality of first adhesive layers, and an opening and closing side of the door curtain is connected with the tent cloth through a zipper.

In preferred embodiment, the tent cloth is disposed with at least one screen window, the at least one screen window is arranged to replace at least one side upper cloth piece of the upper cloth pieces, and a bottom edge of the at least one screen window is attached to the top edges of the lower cloth pieces.

In preferred embodiment, the base cloth and the surrounding barrier are formed by splicing at least two pieces of damp-proof fabric, and a splicing position of the at least two pieces of damp-proof fabric is disposed with a third adhesive layer of the plurality of adhesive layers and is not coincident with a boundary line between the surrounding barrier and the base cloth.

In preferred embodiment, the surrounding barrier is attached to an inner wall of a bottom of the tent cloth, and the second adhesive layer is disposed between the surrounding barrier and the inner wall of the bottom of tent cloth.

In preferred embodiment, the periphery of the tent cloth is disposed with one or more continuous pipe sleeves or discrete pipe sleeves, and the one or more tent rods pass through the one or more continuous pipe sleeves or the discrete pipe sleeves.

In preferred embodiment, the outer tent is formed by obliquely splicing triangular waterproof fabrics, and a continuous adhesive layer is disposed at a splicing position of the triangular waterproof fabrics.

In preferred embodiment, the outer tent is attached with one or more hanging lugs, and the one or more hanging lugs are connected with one or more pulling ropes.

In preferred embodiment, all sides of the outer tent comprise a covered edge.

In preferred embodiment, a shape of each of the plurality of adhesive layers is preferably, but not limited to, a strip and is prepared by using thermoplastic polyurethanes (TPU) hot melt adhesive, TPU paper tape, or liquid glue.

Compared with the existing techniques, the technical solution has the following advantages.

The inner tent or the outer tent of the present disclosure achieves seamlessly bonding through the plurality of adhesive layers, which can not only achieve the adhesion between the same materials (such as the polyester fabric) and the adhesion between different materials (such as the polyester fabric and the zipper, the polyester fabric and mesh, the polyester fabric and loop and hook materials, the polyester fabric and polyvinyl chloride (PVC) film, the polyester fabric and webbing, the polyester fabric and polyethylene (PE) base fabric, etc.), but also avoid the needle holes generated during sewing and splicing, and there is no problems of rain leakage after the needle eye is opened. The base cloth is groove-shaped, which is connected to form an integral structure with the inner tent through seamless attaching, so as to avoid harming the user due to leftover breakage of needles in the production process. The upper cloth pieces are connected to the lower cloth pieces, which is similar to a lamination method of sheets, so as to ensure that when the rainwater flows down from the edge of the upper cloth pieces to the lower cloth pieces, the screen windows are set at the position of the upper cloth pieces, and the outer tent, which is used as a tarpaulin, covers the screen windows to inhibit the water from entering the plurality of adhesive layers and ensuring the bonding stability.

BRIEF DESCRIPTION OF THE DRAWINGS

In order to illustrate the embodiments of the present disclosure or the technical solutions in the prior art more clearly, the following briefly introduces the accompanying drawings used in the description of the embodiments or the prior art. Obviously, the accompanying drawings in the following description are some embodiments of the present disclosure. For those of ordinary skill in the art, other drawings can also be obtained from these drawings without creative labor.

DETAILED DESCRIPTION OF THE EMBODIMENTS

Figure 1:
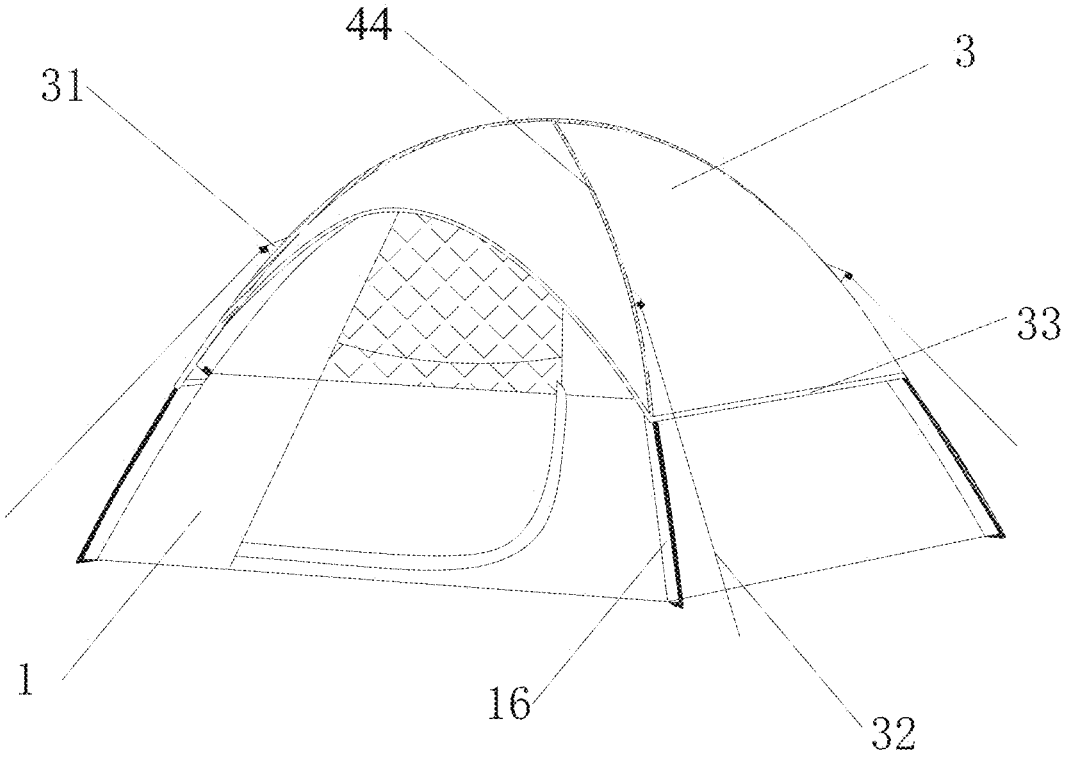
FIG. 1 illustrates an overall perspective view of Embodiment 1.

The present disclosure will be further described below in combination with the accompanying drawings and embodiments.

It should be noted that the terms "upper", "lower", "front", "rear", "left", "right", "top", "bottom", "inner", "outer", etc. indicate the orientation or the positional relationship based on the orientation or positional relationship shown in the accompanying drawings, which is only for the convenience of describing the present disclosure and simplifying the description, rather than indicating or implying that the referenced device or element must have a specific orientation, and be constructed and operated in a specific orientation, so it should not be construed as a limitation of the present disclosure.

Embodiment 1

A seamless attached tent comprises an inner tent 1 and an outer tent 3.

The inner tent 1 comprises a tent cloth, one or more tent rods 16, and a base cloth 2. The tent cloth is made of waterproof polyester fabric and comprises a plurality of cloth pieces and a plurality of first adhesive layers 4, and adjacent cloth pieces of the plurality of cloth pieces are attached together through an adhesive layer 41 of the plurality of first adhesive layers 41. The one or more tent rods 16 are connected to an outer side of the tent cloth, and the outer side of the tent cloth is disposed with one or more continuous pipe sleeves 15 or discrete pipe sleeves 15. The one or more tent rods 16 pass through the one or more continuous pipe sleeves 15 or the discrete pipe sleeves 15. The base cloth 2 is disposed below the tent cloth, and the base cloth 2 is rectangular. All sides of the base cloth 2 extend upward to form a surrounding barrier 21, and corners of the surrounding barrier 21 are attached with reinforcing blocks 22 through a second adhesive layer 42. The outer tent 3 covers a top of the inner tent 1. The plurality of first adhesive layers 41 and the second adhesive layer 42 of this embodiment adopt thermoplastic polyurethanes (TPU) hot melt adhesive.

Figure 2:
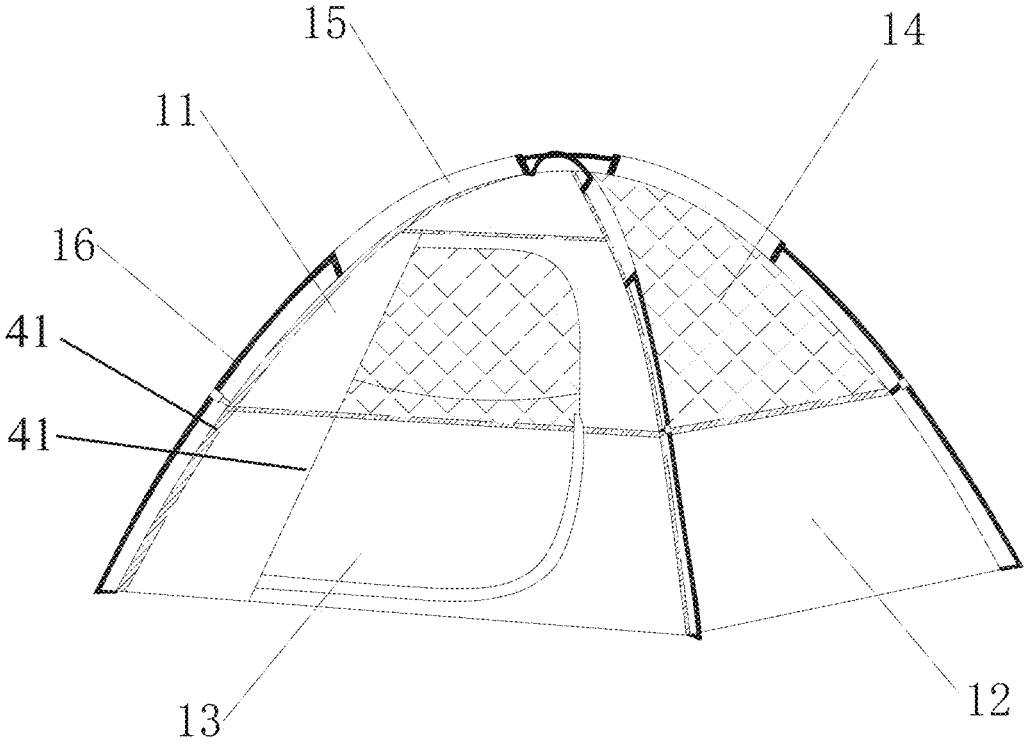
FIG. 2 illustrates a perspective view of an inner tent of Embodiment 1.

Referring to FIG. 2, the tent cloth comprises upper cloth pieces 11 of the plurality of cloth pieces and lower cloth pieces 12 of the plurality of cloth pieces. Bottom edges of the upper cloth pieces 11 are attached to top edges of the lower cloth pieces 12. One or more of the upper cloth pieces 11 are further disposed with one or more top cloth pieces of the plurality of cloth pieces, and a bottom edge of each of the one or more top cloth pieces is also attached to a top edge of a corresponding one of the upper cloth pieces 11. The tent cloth is disposed with a door curtain 13, and a joint between a fixed side of the door curtain 13 and the tent cloth is disposed with another adhesive layer 41 of the plurality of first adhesive layers 41. An opening and closing side of the door curtain 13 is connected with the tent cloth through a zipper. The tent cloth is disposed with screen windows 14. The screen windows 14 are arranged to replace a left side upper cloth piece 11 and a right side upper cloth piece 11 of the upper cloth pieces 11, and bottom edges of the screen windows 14 are attached to the top edges of the lower cloth pieces 12.

Figure 3:
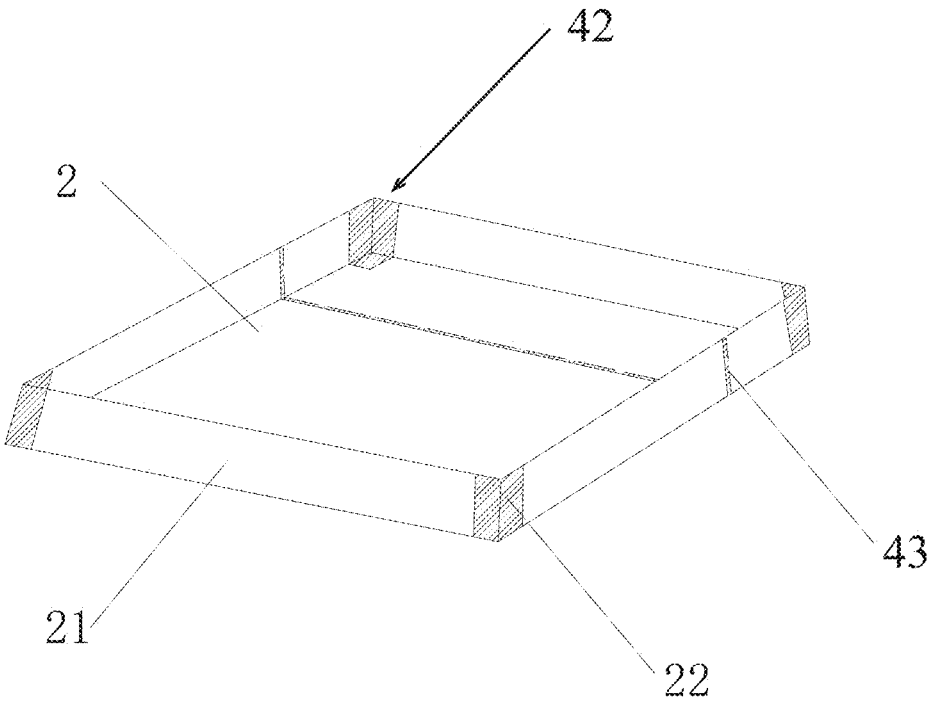
FIG. 3 illustrates a perspective view of a base cloth of Embodiment 1.
Figure 4:
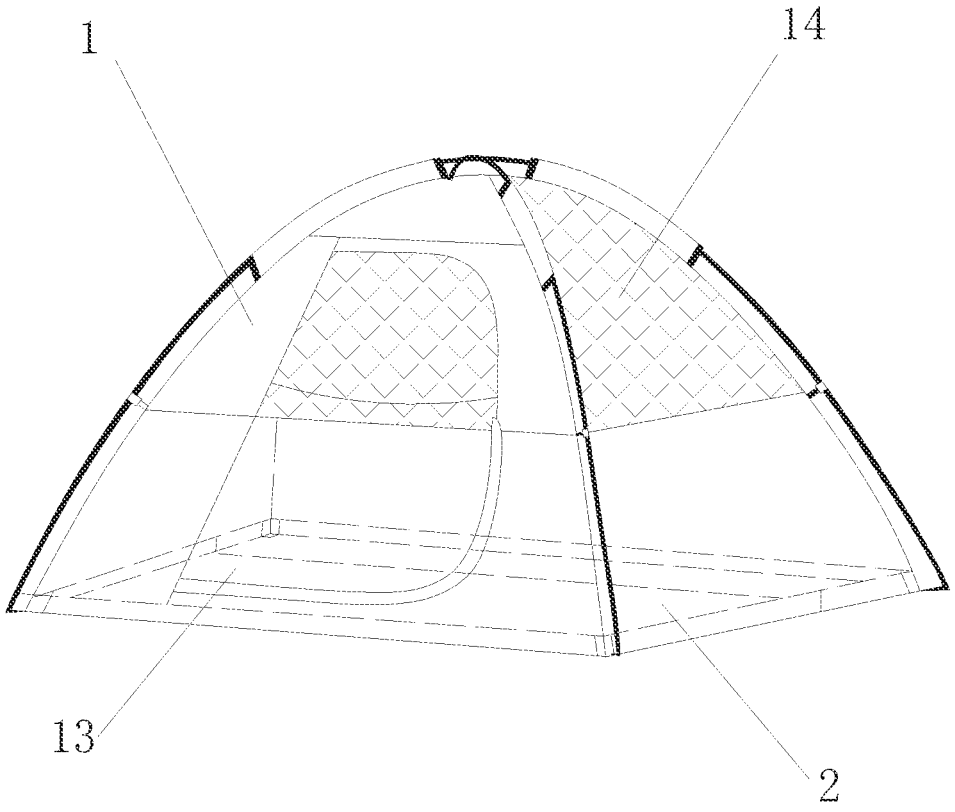
FIG. 4 illustrates a perspective view of the inner tent of Embodiment 1.

Referring to FIG. 3, the base cloth 2 and the surrounding barrier 21 are formed by splicing at least two pieces of damp-proof fabric, and a splicing position of the at least two pieces of damp-proof fabric is disposed with a third adhesive layer 43 and is not coincident with a boundary line between the surrounding barrier 21 and the base cloth 2. The surrounding barrier 21 is attached to an inner wall of a bottom of the tent cloth, and the second adhesive layer 42 is disposed between the surrounding barrier 21 and the inner wall of the bottom of the tent cloth.

The outer tent 3 is formed by obliquely splicing triangular waterproof fabrics, and a continuous adhesive layer 44 is disposed at a splicing position of the triangular waterproof fabrics. An attachment seam of the outer tent 3 is attached with one or more hanging lugs 31, and the one or more hanging lugs 31 are connected with one or more pulling ropes 32. All sides of the outer tent 3 comprise a covered edge 33. When the outer tent 3 is tensioned, a side of the covered edge 33 covering the screen windows 14 is tensioned to be in a straight line and is positioned below the screen windows 14, and rainwater is prevented from entering. A side of the covered edge 33 covering the door curtain 13 is tensioned to form an arc line, so that the door curtain 13 is prevented from being influenced. The third adhesive layer 43 and the continuous adhesive layer 44 of this embodiment adopt thermoplastic polyurethanes (TPU) hot melt adhesive.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A seamless attached tent, comprising:

an inner tent, and an outer tent, wherein:

the inner tent comprises a tent cloth, one or more tent rods, and a base cloth, the tent cloth comprises a plurality of cloth pieces and a plurality of first adhesive layers, adjacent cloth pieces of the plurality of cloth pieces are attached together through an adhesive layer of the plurality of first adhesive layers, the one or more tent rods are connected to a periphery of the tent cloth, the base cloth is disposed on a lower side of the tent cloth, all sides of the base cloth extend upward to form a surrounding barrier, corners of the surrounding barrier are attached with reinforcing blocks through a second adhesive layer, the outer tent covers a top of the inner tent, the outer tent is formed by obliquely splicing triangular waterproof fabrics, and a continuous adhesive layer is disposed at a splicing position of the triangular waterproof fabrics.

2. The seamless attached tent according to claim 1, wherein:

the plurality of cloth pieces comprise upper cloth pieces and lower cloth pieces, and bottom edges of the upper cloth pieces are attached to top edges of the lower cloth pieces.

3. The seamless attached tent according to claim 2, wherein:

the tent cloth comprises a door curtain, a joint between a fixed side of the door curtain and the tent cloth is disposed with another adhesive layer of the plurality of first adhesive layers, and an opening and closing side of the door curtain is connected with the tent cloth through a zipper.

4. The seamless attached tent according to claim 2, wherein:

the tent cloth is disposed with at least one screen window, the at least one screen window is arranged to replace at least one side upper cloth piece of the upper cloth pieces, and a bottom edge of the at least one screen window is attached to the top edges of the lower cloth pieces.

5. The seamless attached tent according to claim 1, wherein:

the base cloth and the surrounding barrier are formed by splicing at least two pieces of damp-proof fabric, and a splicing position of the at least two pieces of damp-proof fabric is disposed with a third adhesive layer and is not coincident with a boundary line between the surrounding barrier and the base cloth.

6. The seamless attached tent according to claim 5, wherein the third adhesive layer is thermoplastic polyurethanes (TPU) hot melt adhesive, TPU paper tape, or TPU liquid glue.

7. The seamless attached tent according to claim 5, wherein the third adhesive layer achieves adhesion between same materials or adhesion between different materials.

8. The seamless attached tent according to claim 1, wherein:

the surrounding barrier is attached to an inner wall of a bottom of the tent cloth, and the second adhesive layer is disposed between the surrounding barrier and the inner wall of the bottom of the tent cloth.

9. The seamless attached tent according to claim 1, wherein:

the periphery of the tent cloth is disposed with one or more continuous pipe sleeves or discrete pipe sleeves, and the one or more tent rods pass through the one or more continuous pipe sleeves or the discrete pipe sleeves.

10. The seamless attached tent according to claim 1, wherein:

the outer tent is attached with one or more hanging lugs, and the one or more hanging lugs are connected with one or more pulling ropes.

11. The seamless attached tent according to claim 1, wherein:

all sides of the outer tent comprise a covered edge.

12. The seamless attached tent according to claim 1, wherein the plurality of first adhesive layers, the second adhesive layer, and the continuous adhesive layer are thermoplastic polyurethanes (TPU) hot melt adhesive, TPU paper tape, or TPU liquid glue.

13. The seamless attached tent according to claim 1, wherein:

the tent cloth comprises screen windows and a door curtain, and when the outer tent is tensioned, a side of a covered edge of the outer tent covering the screen windows is tensioned to be in a straight line and is positioned below the screen windows, and rainwater is prevented from entering into the screen windows, and a side of the covered edge covering the door curtain is tensioned to form an arc line.

14. The seamless attached tent according to claim 1, wherein the plurality of first adhesive layers, the second adhesive layer, and the continuous adhesive layer achieve adhesion between same materials or adhesion between different materials.

* * * * *